US010196916B2

(12) United States Patent
Matthews et al.

(10) Patent No.: US 10,196,916 B2
(45) Date of Patent: Feb. 5, 2019

(54) ROTOR DISK HAVING AN END-SIDE SEALING ELEMENT

(71) Applicant: Siemens Aktiengesellschaft, Munich (DE)

(72) Inventors: Roger Matthews, Greer, SC (US); Karsten Kolk, Mulheim a.d. Ruhr (DE); Peter Schröder, Essen (DE); Dirk Springborn, Berlin (DE); Vyacheslav Veitsman, Gelsenkirchen (DE)

(73) Assignee: Siemens Aktiengesellschaft, Munich (DE)

( * ) Notice: Subject to any disclaimer, the term of this patent is extended or adjusted under 35 U.S.C. 154(b) by 412 days.

(21) Appl. No.: 15/093,800

(22) Filed: Apr. 8, 2016

(65) Prior Publication Data

US 2017/0292396 A1 Oct. 12, 2017

(51) Int. Cl.
*F01D 11/00* (2006.01)
*F01D 5/02* (2006.01)
*F01D 5/30* (2006.01)

(52) U.S. Cl.
CPC ..... *F01D 11/006* (2013.01); *F01D 5/02* (2013.01); *F01D 5/3015* (2013.01); *F05D 2220/32* (2013.01)

(58) Field of Classification Search
CPC ..... F01D 11/006; F01D 5/02; F01D 5/3015; F05D 2220/32

(Continued)

(56) References Cited

U.S. PATENT DOCUMENTS 3,137,478 A 6/1964 Farrell
8,226,366 B2 7/2012 Brücher et al.

(Continued)

FOREIGN PATENT DOCUMENTS

DE 1212108 B 3/1966
EP 1804338 A1 7/2007

(Continued)

OTHER PUBLICATIONS

DE Search Report dated Mar. 28, 2017, for DE patent application No. 102016208759.2.

(Continued)

*Primary Examiner* — Timothy L Maust
(74) *Attorney, Agent, or Firm* — Beusse Wolter Sanks & Maire

(57) ABSTRACT

A rotor disk arrangement having a rotor disk which has, distributed around the outer circumference, a plurality of axially extending blade holding grooves and an encircling fastening protrusion and/or a plurality of fastening protrusions arranged in a circumferentially distributed manner, and having a plurality of sealing elements arranged in a circumferentially distributed manner, the sealing elements covering the blade holding grooves at least in portions on the end side and having, on the side facing the rotor axis, at least one fastening portion that bears against the underside of the fastening protrusion, wherein the fastening protrusion is embodied in an undercut manner, wherein the distance thereof from the rotor axis at the free end facing away from the rotor disk is less than in a region within the fastening protrusion.

20 Claims, 5 Drawing Sheets

(58) Field of Classification Search
USPC ..... 416/220 R
See application file for complete search history.

(56) References Cited

U.S. PATENT DOCUMENTS

| | | | | |
|---|---|---|---|---|
| 9,181,810 | B2 * | 11/2015 | Dimmick, III | F01D 5/3015 |
| 9,366,151 | B2 * | 6/2016 | Dimmick, III | F01D 11/006 |
| 2009/0148298 | A1 | 6/2009 | Strohl et al. | |
| 2010/0232938 | A1 * | 9/2010 | Harris, Jr. | F01D 5/26 415/173.1 |
| 2012/0128504 | A1 | 5/2012 | Ahaus et al. | |
| 2013/0294927 | A1 | 11/2013 | Dimmick, III et al. | |
| 2016/0186590 | A1 * | 6/2016 | Himes | F01D 5/3015 416/183 |

FOREIGN PATENT DOCUMENTS

| | | | | | |
|---|---|---|---|---|---|
| EP | 1944471 | A1 | | 7/2008 | |
| EP | 1944472 | A1 | * | 7/2008 | F01D 5/3015 |
| EP | 2399004 | A1 | | 12/2011 | |
| EP | 2662533 | A2 | | 11/2013 | |
| GB | 2244100 | A | | 11/1991 | |
| GB | 2415230 | A | * | 12/2005 | F01D 5/3015 |
| JP | 2007032282 | A | | 2/2007 | |

OTHER PUBLICATIONS

International Search Report dated Jun. 30, 2017, for PCT/EP2017/058255.

* cited by examiner

ROTOR DISK HAVING AN END-SIDE SEALING ELEMENT

FIELD OF INVENTION

The invention relates to a rotor disk arrangement having a rotor disk and sealing elements arranged in front of an end side.

BACKGROUND OF INVENTION

In a rotor of a gas turbine, use is generally made of rotor disks which have, distributed around the outer circumference, a multiplicity of blade holding grooves in each of which a rotor blade is fastened by way of a blade holding profile. This makes it possible to replace the rotor blade in the event of wear. It is furthermore known that the blade holding grooves should be protected against the penetration of the hot gas flowing through the gas turbine. To this end, circumferentially distributed segmented sealing elements are used in a known manner in front of the end side of the rotor disk. Embodiments that are known in this regard are known for example from EP 1 804 338 A1, EP 1 944 471 A1 and from EP 2 399 004 A1. In these cases, the sealing elements generally have a flat shape and extend from an annular groove beneath the blade holding grooves to beyond the outer circumference of the rotor disk. Thus, the blade holding grooves are reliably covered by the sealing elements. The sealing elements are fastened to the rotor disk or to the rotor blades in different ways, wherein, to this end, the sealing elements are generally mounted on the inner circumference in an annular groove of the rotor disk. The sealing elements are likewise usually secured axially to the outer circumference in an annular groove which is formed by the circumferentially segmented mutually adjoining rotor blades.

Upon rotation of the rotor, the sealing elements are usually supported in the annular groove in the rotor blades. In this case, the centrifugal force on the sealing elements additionally stresses the in any case highly stressed rotor blades.

SUMMARY OF INVENTION

Therefore, it is an object of the present invention to provide fastening for the sealing elements which frees the rotor blades from the centrifugal force of the sealing elements.

This object addressed is achieved by an embodiment according to the invention of a rotor disk arrangement, a rotor according to the invention and a gas turbine according to the invention as claimed. Advantageous embodiments are the subject matter of the dependent claims.

The generic rotor disk arrangement first of all comprises a rotor disk. The latter has, distributed around the outer circumference, a plurality of axially extending blade holding grooves. In this case, it is not absolutely necessary for the blade holding grooves to extend parallel to the rotor axis, even though this represents the advantageous and cost-effective embodiment. Rather, it is sufficient for the blade holding grooves to extend from one end side of the rotor disk to the other end side of the rotor disk. In this case, they can have both a curved course and advantageously a rectilinear course.

Furthermore, the rotor disk arrangement comprises a plurality of sealing elements arranged in a circumferentially distributed manner. In order to fix the sealing elements to the rotor disk, the rotor disk has an encircling fastening protrusion and/or a plurality of fastening protrusions arranged in a circumferentially distributed manner. Here, provision is made for the fastening protrusion to extend at least in the axial direction. To this end, the individual sealing elements each have at least one fastening portion which bears against the fastening protrusion. In this case, provision is made for the fastening portion to be located on the underside beneath the fastening protrusion, on the side facing the rotor axis.

According to the invention, it is now the case that mounting of the sealing elements on the rotor disk, with a transmission of the rotation-induced centrifugal forces from the sealing elements to the rotor disk, is made possible by virtue of the fastening protrusion being embodied in an undercut manner. This necessitates that the distance of the fastening protrusion from the rotor axis at the free end of said fastening protrusion is less than in a region within the fastening protrusion. Here, the free end is designed as that end of the fastening protrusion which faces away from the rotor disk, against which end the fastening portion of the sealing elements bears.

By means of this novel embodiment, a situation is avoided in which the sealing elements have to be supported at the outer circumference in holding grooves in the rotor blades. In this way, the rotor blades are relieved of the centrifugal force of the sealing elements. In this respect, the sealing elements are now suspended on the rotor disk, wherein the centrifugal force during rotation of the rotor disk arrangement leads to secure positioning of the sealing elements on the rotor disk both in an axial direction and in a radial direction.

Here, it is particularly advantageous if all of the sealing elements together form a substantially closed rotary body. Here, "substantially" signifies that gaps may possibly remain between the individual sealing elements, wherein, in a particularly preferred manner, the gaps are arranged in each case between two blade holding grooves.

Furthermore, it is particularly advantageous if the sealing elements completely cover the blade holding grooves on the end side.

It is furthermore advantageous if all of the sealing elements are designed as identical parts.

In a preferred embodiment of the fastening protrusion, the latter has a bearing surface, facing the rotor axis, which is either embodied in a planar manner and/or forms a portion of a conical surface. Here, provision is made for the distance of the bearing surface from the rotor axis to decrease continuously toward the free end. This leads to the particularly advantageous effect that, during rotation of the rotor disk arrangement and in the presence of the centrifugal force that arises here, the bearing surface, which rises toward the rotor disk, causes the sealing element to be pulled onto the rotor disk. Thus, secure positioning of the sealing elements on the rotor disk is realized in a particularly reliable manner.

With regard to the design of the fastening protrusion or of a multiplicity of fastening protrusions, it is firstly possible to select an encircling fastening protrusion. This may optionally end, by way of its free end, at the end side of the rotor disk. In this respect, the free space required for the arrangement of the fastening portions in the case of an encircling fastening protrusion is realized by way of an encircling groove which is recessed axially into the rotor disk and which is situated radially beneath the fastening protrusion. The encircling fastening protrusion may likewise be formed so as to project, partially or entirely, axially beyond the end side. In this way, weakening as a result of a groove that otherwise is recessed into the rotor disk is avoided or at least reduced.

As an alternative to this, it is likewise possible to provide a multiplicity of fastening protrusions arranged in a circumferentially distributed manner. In this case, the fastening protrusions extend at least partially beyond the end side. In a preferred arrangement, the fastening protrusions are in this case arranged in radially symmetrical fashion.

In this case—in particular with the selection of a planar bearing surface and/or a bearing surface in the form of a portion of a conical surface—it is particularly advantageous if the thickness of a fastening protrusion extending beyond the end side, as measured in a direction perpendicular to the bearing surface, is constant or decreases toward the free end. This leads to advantageous installation of the sealing element, because in this case, in the sealing element, it is merely necessary to provide the free space necessary for the fastening protrusion in the final installed position.

As an alternative to this, it is possible for the fastening protrusion to be designed such that the free end is formed by a securing web extending to the rotor axis. Here, the securing web bounds, in an axial direction, a bearing groove, which opens radially toward the rotor axis, in the fastening protrusion. This makes it possible for a sealing plate to be hooked into the bearing groove on the securing web radially from the inside.

With regard to the design of the fastening portion, there are likewise various available possibilities. In a first embodiment, the fastening portion on the sealing element runs (as viewed in a circumferential direction) over the entire width of the sealing element. Here, it is necessary for the fastening portion to extend in a manner axially facing the rotor disk. This embodiment permits both the attachment of the sealing element to an encircling fastening protrusion and in the case of individual spaced-apart fastening protrusions.

In an alternative embodiment, the fastening protrusion runs, again as viewed in a circumferential direction—within the sealing element, and is thus spaced apart from the two opposite side peripheries of the sealing element. For this purpose, above the fastening portion, there is situated a fastening receptacle which is recessed axially into the sealing element or a fastening receptacle which extends all the way through the sealing element. Said fastening receptacle likewise has a spacing to each of the two side peripheries of the sealing element. This embodiment advantageously facilitates the attachment of the sealing element to a fastening protrusion which is raised in relation to the end side of the rotor disk. In this case, the fastening protrusion is laterally surrounded, in a circumferential direction, by the sealing element.

With regard to the arrangement of the fastening protrusion on the rotor disk and, in association therewith, of the fastening receptacle on the sealing plate in a radial direction, that is to say the selection of the distance from the rotor axis and thus in relation to the blade holding grooves, there are likewise various possibilities available. Although it would be possible for the fastening protrusion or the fastening receptacle to be arranged in the radially outer region of the sealing element, it is nevertheless particularly advantageous for the fastening portion to be arranged in the peripheral region, facing toward the rotor axis, of the sealing element. Firstly, in this way, an arrangement of the fastening protrusion on the rotor disk radially beneath the blade holding grooves and/or in the region facing radially toward the rotor axis between two blade holding grooves is possible. In this way, the region that is subjected to high load by the rotor blades during rotation is not subjected to additional load by the sealing plates. Secondly, the arrangement of the fastening portion at the radially inner periphery leads to advantageous stabilization as a result of the centrifugal force, with axially secure abutment directly or indirectly on the end side, because the center of gravity of the sealing element is situated radially above the fastening portion.

For the reliable fixing of the sealing elements, in particular when the rotor disk arrangement is at a standstill, it is furthermore advantageous for a second axial securing action of the sealing plate on the rotor disk to be realized in the radially outer region. For this purpose, it is advantageous if, on the rotor disk, there are provided at least two, in particular several, depressions arranged in a circumferentially distributed manner between the blade holding grooves. In a preferred embodiment, a corresponding depression is situated in each case between two blade holding grooves in the outer region of the rotor disk. These depressions should in this case likewise be of undercut form, wherein the depressions extend in a radial direction. For this purpose, at least two sealing elements each have at least one elevation which engages into the depression, and which likewise correspondingly extends radially. As a result of the engagement of the elevation into the depression, it is possible in a simple manner for the axial position of the sealing plate in the radially upper region on the rotor disk to be fixed.

For the realization of the depression and/or of the elevation, it is furthermore advantageous if the depression is situated in front of the end side of the rotor disk and, here, is designed to open toward the rotor axis. Here, it may be provided that the depression widens in a continuous manner, wherein, by contrast, it is advantageous for said depression to extend in a straight manner to the rotor axis and thus form a radially inwardly opening groove. The elevation is particularly advantageously designed so as to be correspondingly complementary to the depression, such that the axial fixing of the sealing plate is ensured by way of the engagement of the elevation into the depression.

To permit the installation of the sealing element, it is furthermore particularly advantageous if the fastening receptacle has a free space radially above the fastening protrusion. Here, the free space serves to allow an installation or removal by way of a movement of the sealing element relative to the rotor disk in order to realize the engagement of the elevation into the depression. Correspondingly, the free space must be designed to be large enough that the sealing element can be placed onto the fastening protrusion and pushed by way of the elevation into the depression.

In the case of a free space being provided between the fastening protrusion and the sealing element, it is furthermore advantageous if the free space is covered by a securing plate. In this regard, it is not of importance whether, to both sides of the fastening protrusion, there is likewise situated a free space which can likewise be covered by the securing plate. At the least, it is advantageous in this case if the securing plate is fixed with a peripheral portion in a radially extending plate groove. Here, it is provided that, as a result of the engagement of the peripheral portion in the plate groove, the securing plate is axially fixed and, in this way, at the same time, the sealing element is secured axially on the rotor disk. Furthermore, in the case of a securing plate being used, it is provided that the latter is supported in the groove bottom and is thus radially fixed in one direction. By contrast, on the radially opposite peripheral portion of the securing plate, there is arranged a securing protrusion, with which the securing plate comes into radial contact opposite the plate groove. Thus, radial fixing of the securing plate is likewise realized. Here, it is initially not of importance whether the plate groove is arranged in the fastening protrusion and the securing protrusion is arranged on the sealing element, or conversely the plate groove is arranged on the sealing element and the securing protrusion is arranged on the fastening protrusion. At the least, through the selection of the height of the securing protrusion and of the provided play for the joining of the securing plate in the plate groove and abutment on the securing protrusion, an elastic deformation of the securing plate required for installation purposes can be defined, which in turn prevents an undesired loss of the securing plate.

In an alternative embodiment, for the axial and/or radial and/or tangential securing of the sealing elements, it is likewise possible to use a securing element which passes through the sealing element at least in portions and engages in a cutout in the rotor disk. Here, in the simplest case, said securing element may be a securing bolt which is fixed axially in the rotor disk so as to extend through the sealing element. In this regard, a multiplicity of different embodiments is already available to a person skilled in the art. At the least, in this case, it is advantageous if the securing element is arranged radially beneath the fastening protrusion, that is to say on that side of the fastening protrusion which faces toward the rotor axis.

In a further alternative embodiment, it is possible to prevent a displacement of the sealing element in a radial and/or tangential direction by virtue of a blocking element being arranged on a rotor blade. Here, the blocking element extends axially beyond the end side and, here, may engage into a cutout on the sealing element.

The design of the sealing element is not of primary importance as long as the desired coverage of the blade holding grooves is realized. What is particularly advantageous is a design in which the sealing element comprises a substantially flat sealing portion facing the rotor axis, and a radially outwardly facing wing portion. Here, the sealing portion is provided substantially for covering the blade holding groove in portions and for securing the sealing element by way of the fastening portion on the fastening protrusion. By contrast, the wing portion is embodied in a radially outwardly opening U-shaped or V-shaped manner in a cross section along the rotor axis. Thus, the wing portion forms a first wing web, arranged on the end side, and a second wing web, spaced apart from the first wing web, which wing webs extend in a radially outwardly facing manner. Thus, it is possible to realize further advantageous sealing both with respect to the rotor blades and with respect to static guide blades.

Furthermore, for the best possible sealing of the blade holding grooves, it is advantageous if a first sealing element has, on at least one side periphery, a sealing tab facing the end side, whereas by contrast, an adjacent, second sealing element has, on a second periphery, a sealing shoulder in which the sealing tab engages. In this respect, an overlap of the second sealing element over the first sealing element is made possible. Here, it is particularly advantageous if the first sealing element correspondingly has in each case one sealing tab at both side peripheries that are opposite one another in the circumferential direction, whereas by contrast, the second, adjacent sealing element correspondingly has a sealing shoulder at the opposite side peripheries. In this respect, an alternating arrangement of the first and second sealing elements on the end side of the rotor disk is possible.

In the abovementioned embodiment in particular, it is particularly advantageous if a sealing element, or the second sealing element in the above embodiment, has side peripheries which run parallel to one another as viewed in the circumferential direction. It is thus ensured that, during insertion of the second sealing element in the axial and radial directions between the existing sealing elements, no collision occurs between the sealing element to be inserted last and the previously installed sealing elements.

BRIEF DESCRIPTION OF THE DRAWINGS

Exemplary embodiments of an arrangement according to the invention of sealing elements on a rotor disk are depicted in the following figures, in which.

DETAILED DESCRIPTION OF INVENTION

Figure 1:
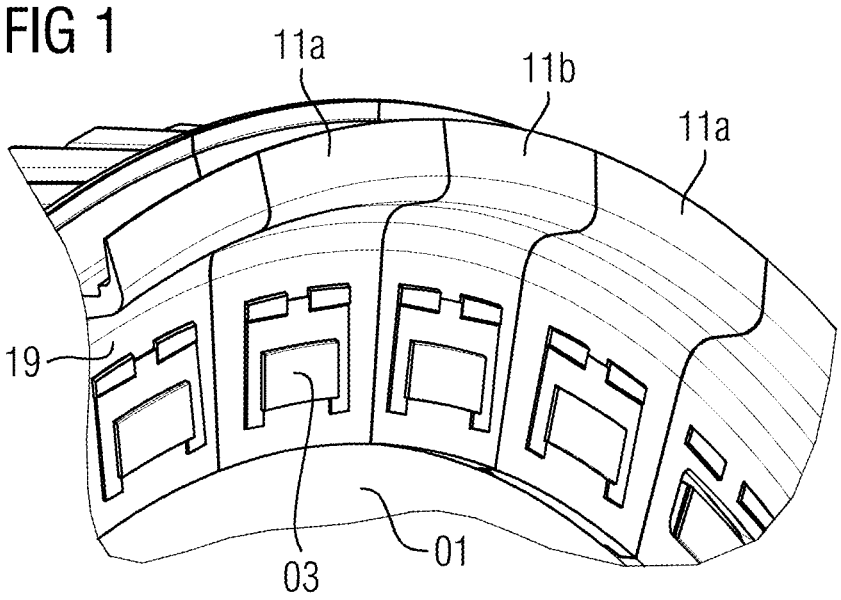
FIG. 1 shows, in a detail, a perspective view of a rotor disk arrangement with hooked-in sealing elements.

FIG. 1 depicts, in a detail, a perspective view of an exemplary embodiment of a rotor disk arrangement according to the invention. Said rotor disk arrangement comprises a rotor disk 01 and a multiplicity of sealing elements 11 fastened to the rotor disk 01. In the subsequent FIG. 2, in the same view as FIG. 1, the rotor disk arrangement is depicted without a sealing element 11*a*. It is possible to see the arrangement of the multiplicity of sealing elements 11*a*, 11*b* adjacent to one another so as to form a substantially closed ring. Here, the sealing elements 11 are situated in front of an end side 02 of the rotor disk 01 and cover, on the end side, rotor blade grooves 09 provided in the rotor disk 01. It emerges in an obvious manner that the blade holding grooves 09, of which there is a multiplicity, are likewise arranged in a circumferentially distributed manner.

For the fastening of the sealing elements 11, the rotor disk 01 has in each case a fastening protrusion 03, which 03 extends substantially axially from the end side 02. To each fastening protrusion 03 there is fastened in each case one sealing element 11. It can be seen in particular from the figure that the fastening protrusions 03 project beyond the sealing elements 11 by way of a free end 04 which is spaced apart from the end side 02. It is also possible to see the arrangement of securing plates 19 between the fastening protrusion 03 of the rotor disk 01 and the respective elevations 18 on the individual sealing elements 11.

Figure 2:
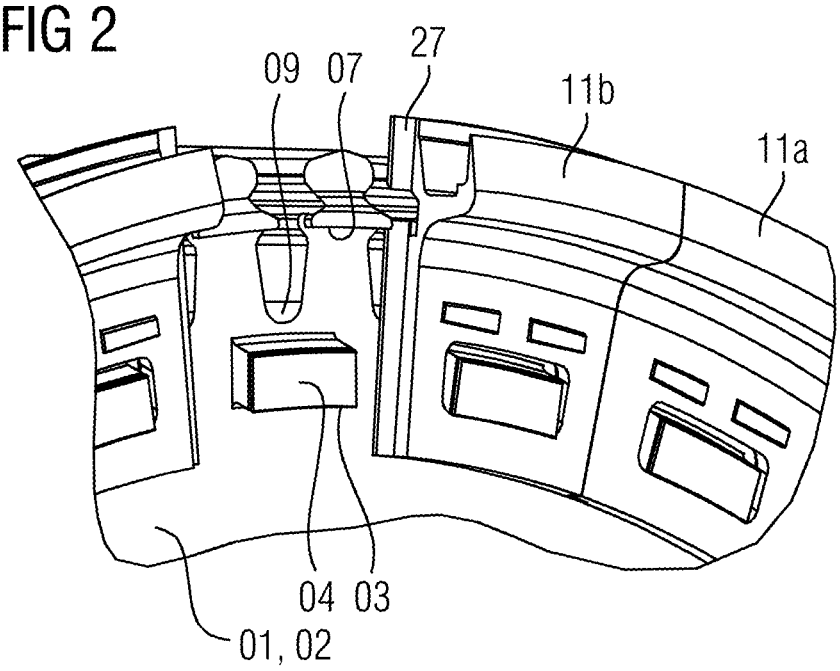
FIG. 2 shows a view analogous to FIG. 1, with the omission of a sealing element.

Furthermore, it can be seen from FIG. 2 in particular that two different sealing elements 11*a* and 11*b* are used in each case alternately, wherein the sealing element 11*b* has, on the side facing toward the end side 02, a sealing tab 27 which protrudes in a circumferential direction. For this purpose, the adjacent sealing element 11*a* has, on the side facing toward the end side 02 of the rotor disk 01, a sealing shoulder 28 in which 28 the sealing tab 27 engages. In this way, advantageous coverage of a joint between the individual sealing elements 11*a*, 11*b* is realized.

Figure 3:
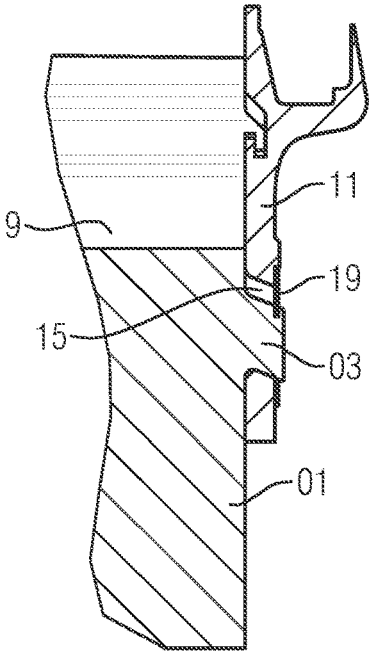
FIG. 3 shows a longitudinal section of the arrangement from FIG. 1.
Figure 4:
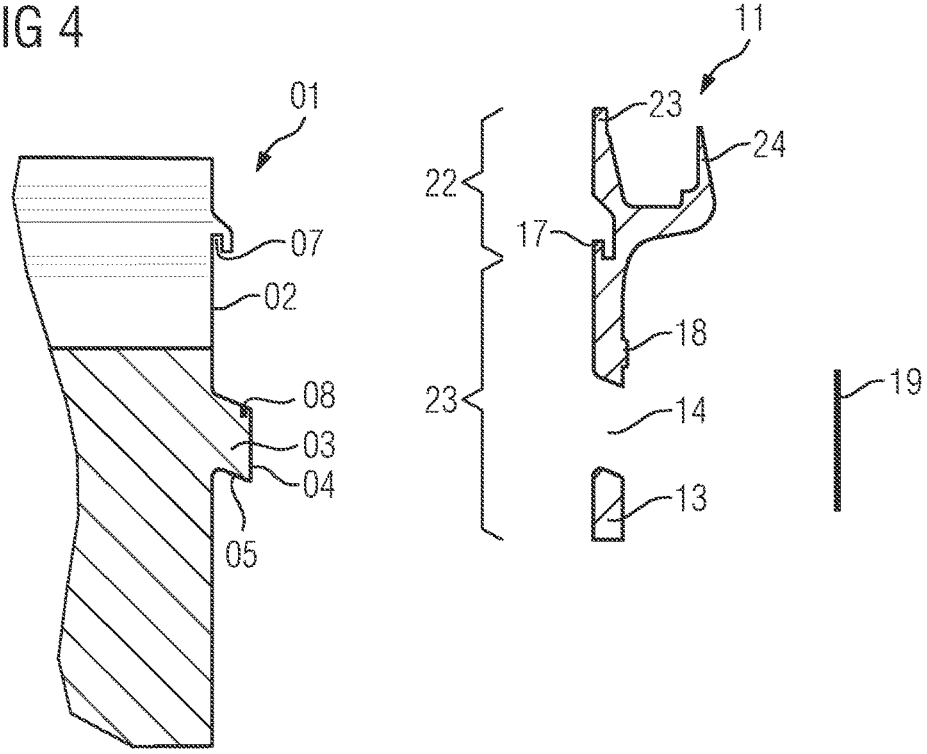
FIG. 4 shows an exploded view of FIG. 3.

The fastening of the sealing elements 11 to the rotor disk 01 can advantageously be seen in a longitudinal section in FIGS. 3 and 4. The rotor disk 01 has the axially extending fastening protrusion 03. Here, the fastening protrusion 03 extends with a bearing surface 05, facing the rotor axis, to a free end 04 which is spaced apart from the end side 02, wherein the distance of the bearing surface 05 from the end side 02 becomes progressively smaller toward the free end 04. Furthermore, the fastening protrusion 03 has, opposite the bearing surface 05 on the radially outwardly directed side, a plate groove 08 which 08 serves for receiving the securing plate 19. From the views, it can also be seen that the fastening protrusion 03 is advantageously situated beneath the rotor blade groove 09 and is thus attached in a stable manner to the rotor disk 01. Spaced apart from the fastening protrusion 03, facing radially away from the rotor axis and above the fastening protrusion 03, there is situated in each case one depression 07 in the form of a receiving groove facing the rotor axis. Here, the depression 07 is likewise arranged in front of the end side 02 and is situated in each case between two blade holding grooves 09.

The sealing element 11 hooked onto the rotor disk 01 has, for the transmission of the centrifugal forces, a fastening portion 13 on the side facing the rotor axis, which 13 extends between the two side peripheries 26 of the sealing element 11. Above the fastening portion 13 there is situated a fastening receptacle 14 which extends through the sealing element 11. As a result of the joining of the sealing element 11 to the rotor disk 01, the fastening protrusion 03 of the rotor disk 01 protrudes into the fastening receptacle 14, wherein the bearing surface 05 of the fastening protrusion 03 comes to bear against the fastening portion 13. As a result of the particularly advantageous design of the fastening protrusion 03 with a downwardly sloping bearing surface 05, the centrifugal force arising in the sealing element 11 during rotation of the rotor disk arrangement causes the sealing element 11 to be pulled onto the end side 02 of the rotor disk 01.

For the axial securing action, the sealing element 11 furthermore has, complementary to the depression 07 of the rotor disk 01, an elevation 17 in the form of a web extending in a circumferential direction. Said radially outwardly extending elevation 17 engages into the depression 07 and thus secures the position of the sealing plate 11 in the axial direction in the outer region.

It can also be seen that the sealing element 11 has a lower sealing portion 21, which faces the rotor axis, and a wing portion 22 situated radially to the outside. Here, the sealing portion 21 is of substantially flat form, that is to say the extent of the sealing portion 21 in an axial direction is considerably smaller than the dimension of the sealing portion 21 in a radial direction or circumferential direction. By contrast, the wing portion 22 is of U-shaped form and, here, forms a first wing web 23, facing the end side 02, and a second wing web 24, which is spaced apart from the first wing web, wherein the wing webs 23, 24 extend radially outward.

The position of the sealing element 11 on the rotor disk 01 is secured by way of a securing plate 19 which 19 is fastened, in front of the sealing element 11, to the fastening protrusion 03 of the rotor disk 01. The insertion of the securing plate 19 into the plate groove 08 provided on the fastening protrusion 03 gives rise to the axial securing of the securing plate 19 and simultaneously of the sealing element 11. Furthermore, in the end position, the securing plate 19 bears, on the radially outwardly facing side, against securing protrusions 18 of the sealing element 11. Thus, radial fixing of the securing element 19 between the sealing element 11 with the securing protrusion 18 and the bottom of the plate groove 08 of the rotor disk 01 is realized. Aside from the securing of the sealing element 11 to the rotor disk 01, the securing plate 19 in this exemplary embodiment simultaneously serves for covering a free space 15 surrounding the fastening protrusion 03, which 15 is provided for allowing the elevation 17 of the sealing element 11 to be fitted into the depression 07 of the rotor disk 01.

Figure 5:
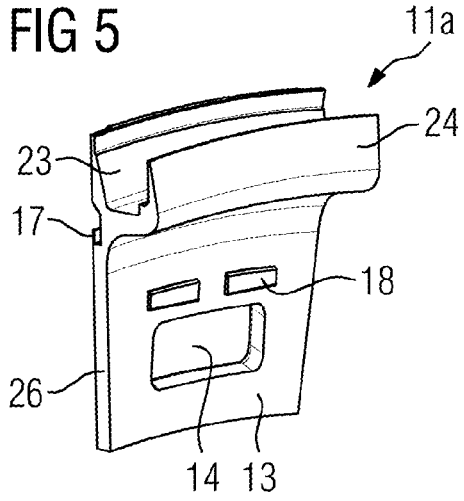
FIG. 5 and FIG. 6 each show perspective views of the embodiment from FIG. 1.
Figure 6:
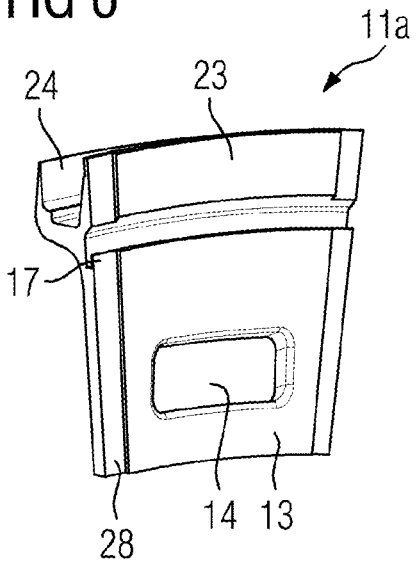

In the following FIGS. 5 and 6, the sealing element 11*a* is depicted in two perspective views. It is firstly possible to see the lower sealing portion 21 with the fastening receptacle 14 which is situated therein and which serves for receiving the fastening protrusion 03. Situated on that side of the fastening receptacle 14 which faces the rotor axis is the fastening portion 13 for accommodating the centrifugal forces of the sealing element 11. The two securing protrusions 18, as abutment surface for the securing plate 19, are situated on the sealing element 11 at the side facing away from the rotor disk 01. Extending in a circumferential direction, and radially spaced apart from the fastening receptacle 14, is the elevation 17 on the side facing the end side 02.

The wing portion 22 which adjoins the sealing portion 21 comprises the first wing web 23 on the side facing the rotor disk and, spaced apart from said first wing web, the second wing web 24, which 23, 24 extend radially outward. It can also be seen that in each case one sealing shoulder 28 is provided on the two side peripheries 26 situated in a circumferential direction, which 28 offers a free space, spaced apart from the end side 02, for the arrangement of the sealing tab 27 of the adjacent sealing element 11*b*.

Figure 7:
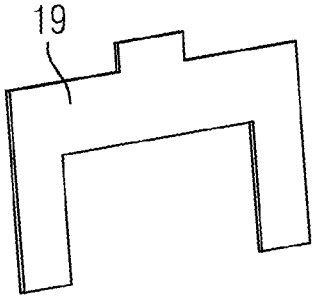
FIG. 7 shows a securing plate of the embodiment from FIG. 1.

FIG. 7 depicts the securing plate 19, which firstly secures the position of the sealing element 11 on the rotor disk 01 and furthermore covers the free space 15, which remains of the fastening receptacle 14, upon the arrangement of the sealing element on the fastening protrusion 03. Here, the securing plate 19 is of U-shaped form.

Figure 8:
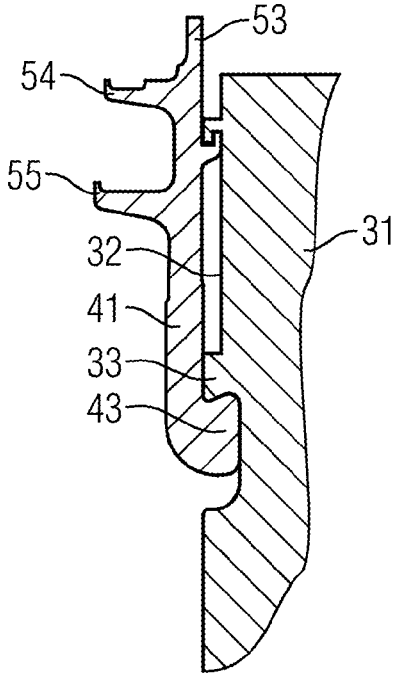
FIG. 8 shows a further exemplary embodiment of a hooked-in sealing element in the longitudinal section analogous to FIG. 3.
Figure 9:
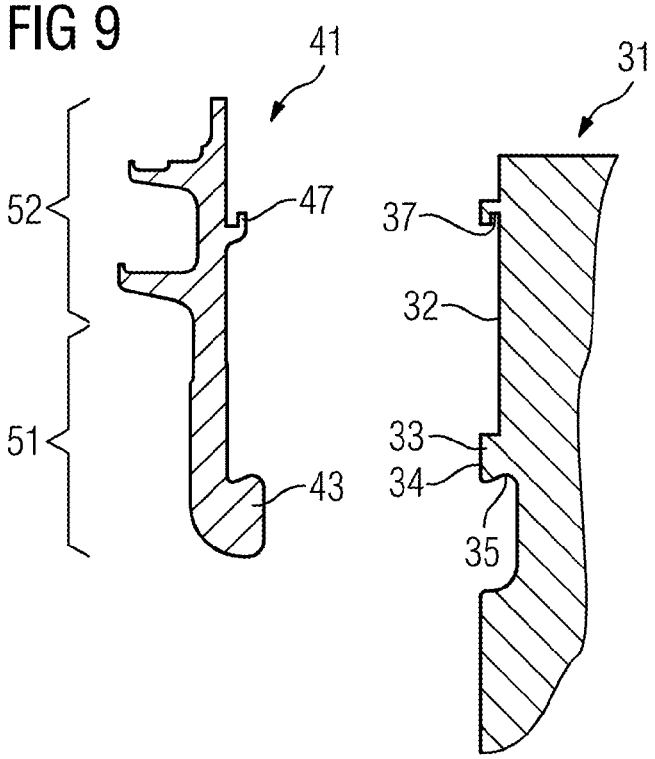
FIG. 9 shows an exploded view of FIG. 8.

FIG. 8 depicts a further exemplary embodiment of a rotor disk arrangement according to the invention in a section analogous to FIG. 3. It is again possible to see, to some extent, the rotor disk 31, on the end side 32 of which a sealing element 41 is arranged. This 41 is, analogously to the preceding exemplary embodiment, hooked onto the rotor disk 31, wherein for this purpose, the rotor disk 31 has a fastening protrusion 33. By contrast to the preceding exemplary embodiment, it is possible in this exemplary embodiment for the fastening protrusion 33 to be formed as an encircling ring.

Here, the fastening protrusion 33 in turn extends axially beyond the end side 32 to a free end 34. Situated on the side facing the rotor axis is the bearing surface 35, which 35 is in turn inclined so as to slope downward an axial direction toward the free end 34. In a design similar to the preceding exemplary embodiment, a depression 37 in the form of a groove extending in a circumferential direction is provided on the rotor disk 31. For this purpose, the sealing element 41 has, analogously to the preceding exemplary embodiment, an elevation 47 which extends in the circumferential direction. The centrifugal forces that arise in the sealing element 42 during rotation of the rotor disk arrangement are transmitted via the fastening portion 43 to the fastening protrusion 33. By contrast to the preceding exemplary embodiment, the fastening portion 43 extends so as to face in an axial direction toward the rotor disk 31. Owing to the inclined orientation of the bearing surface 35 and the design of the fastening portion 43 complementary thereto, it is in turn ensured that the centrifugal forces cause the sealing element 41 to be pulled onto the rotor disk 31. Analogously to the preceding exemplary embodiment, a sealing portion 51 of the sealing element 41 is of substantially flat form, whereas by contrast, a wing portion 52 has multiple wing webs 53, 54 and 55.

Figure 10:
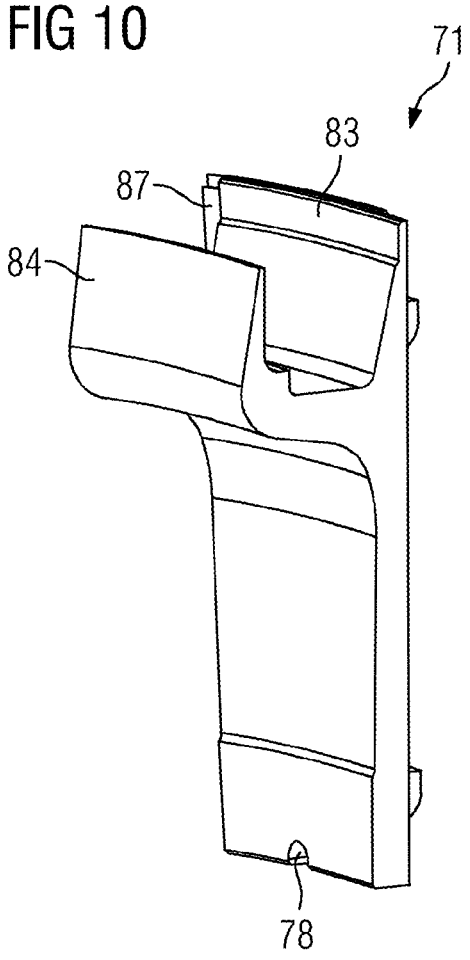
FIG. 10 and FIG. 11 show a further exemplary embodiment of a hooked-in sealing element.
Figure 11:
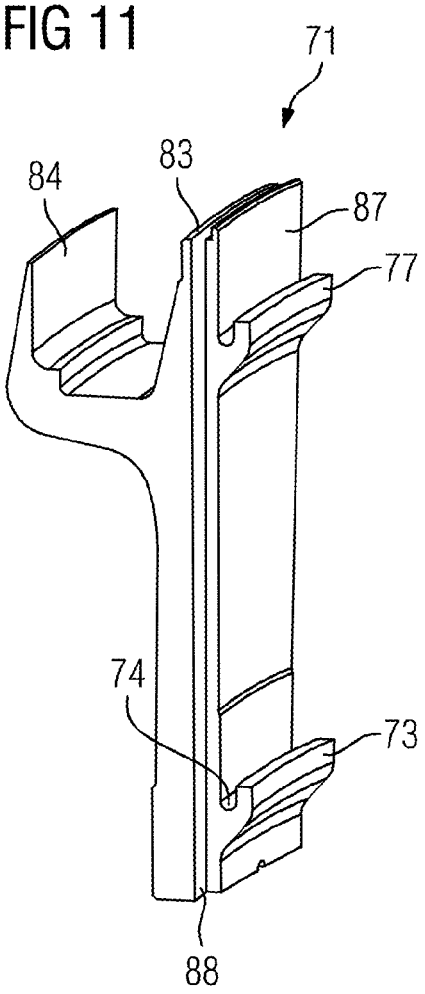

FIGS. 10 and 11 depict a further exemplary embodiment of a sealing element 71 for use in a rotor disk arrangement according to the invention. Analogously to the first exemplary embodiment, it is possible to see the form of the sealing element 71 with a sealing portion and a wing portion, which has a first wing web 83 and a second wing web 84. An overlapping arrangement of the sealing element 71 is, in this exemplary embodiment, realized by the formation of a sealing tab 87 on a side periphery of the sealing element 71, and the arrangement of a sealing shoulder 88 on the opposite side periphery.

The axial securing of the sealing element 71 on the rotor disk is in turn realized, analogously to the preceding exemplary embodiments, by way of a radially outwardly extending elevation 77 on the sealing element 71. The contrast to the preceding exemplary embodiments, on the end facing the rotor axis, there is situated a fastening portion 73 which extends in a circumferential direction and which has a radially outwardly extending web and which has a groove 74. In this respect, by way of the elevation 77 and the fastening portion 73, it is possible for the sealing element 71 to be hooked onto the rotor disk. In any case, provision is made for the centrifugal forces in the sealing element 71 to be transmitted in an advantageous manner via the fastening portion 03 facing the rotor axis, wherein radial abutment against the rotor disk may be provided both at the web 73 and at the bottom of the groove 74.

In this exemplary embodiment, for the radial and tangential securing of the sealing element 71 on the rotor disk, the sealing element 71 is equipped with a securing recess 78 on the side facing the rotor axis, wherein the securing recess 78 is of semicircular form. This allows a securing bolt to be inserted after fitting of the sealing element 71 on the associated rotor disk. Such a securing configuration may obviously likewise be used in the preceding exemplary embodiments for rotor disk arrangements.

The invention claimed is:

1. A rotor disk arrangement having a rotor disk which comprises, distributed around the outer circumference, a plurality of axially extending blade holding grooves and an encircling fastening protrusion and/or a plurality of fastening protrusions arranged in a circumferentially distributed manner, and a plurality of sealing elements arranged in a circumferentially distributed manner, said sealing elements covering the blade holding grooves at least in portions on an end side and comprising, on the side facing a rotor axis, at least one fastening portion that bears against the underside of the fastening protrusion, wherein the fastening protrusion is embodied in an undercut manner, wherein the distance thereof from the rotor axis at a free end facing away from the rotor disk is less than in a region within the fastening protrusion, a first sealing element that comprises, on at least one first side periphery, a sealing tab facing the end side, and a second adjacent sealing element that comprises, on a second side periphery, a sealing shoulder in which the sealing tab engages.

2. The rotor disk arrangement as claimed in claim 1, wherein all of the sealing elements together form a substantially closed rotary body and/or completely cover the blade holding grooves on the end side.

3. The rotor disk arrangement as claimed in claim 1, further comprising a bearing surface, facing the rotor axis, of the fastening protrusion that is embodied in a planar manner and/or as a portion of a conical surface, the distance of said bearing surface from the rotor axis decreasing continuously toward the free end, wherein the fastening protrusion has a constant thickness or a thickness that decreases toward the free end, perpendicularly to the bearing surface.

4. The rotor disk arrangement as claimed in claim 1, wherein the free end of the fastening protrusion is formed by a securing web extending to the rotor axis, said securing web axially bounding a radially inwardly opening bearing groove in the fastening protrusion.

5. The rotor disk arrangement as claimed in claim 1, wherein the fastening portion on the sealing element extends axially in a manner facing the rotor disk, and in the circumferential direction across the entire width of the sealing element.

6. The rotor disk arrangement as claimed in claim 1, further comprising a fastening receptacle that is recessed axially into the sealing element or passes through the sealing element and is spaced apart from side peripheries of the sealing element that is arranged radially above the fastening portion.

7. The rotor disk arrangement as claimed in claim 1, wherein the rotor disk has at least two undercut radial depressions that are arranged in a circumferentially distributed manner in each case between blade holding grooves, and at least two sealing elements each have at least one elevation that engages in the depression.

8. The rotor disk arrangement as claimed in claim 7, wherein a depression is arranged in front of the end face in a manner opening toward the rotor axis, and extends radially with respect to the rotor axis.

9. The rotor disk arrangement as claimed in claim 7, wherein the fastening receptacle forms a free space radially above the fastening protrusion, said free space allowing a removal movement, at least toward the rotor axis, of the elevation out of the depression.

10. The rotor disk arrangement as claimed in claim 9, wherein the free space is covered by a securing plate.

11. The rotor disk arrangement as claimed in claim 10, wherein the securing plate is secured with a peripheral portion in a radially extending plate groove in the fastening protrusion and/or is secured axially in the sealing element and radially in the direction of the bottom of the plate groove, wherein the opposite peripheral portion bears radially against an axially extending securing protrusion.

12. The rotor disk arrangement as claimed in claim 1, further comprising a securing element that passes through the sealing element at least in portions and engages in a cutout in the rotor disk, radially beneath the fastening protrusion.

13. The rotor disk arrangement as claimed in claim 1, further comprising a blocking element that is arranged on at least one rotor blade, said blocking element extending axially beyond the end side and engaging in a cutout, facing the end side, in the sealing element.

14. The rotor disk arrangement as claimed in claim 1, wherein the sealing element has a substantially flat sealing portion facing the rotor axis, and a radially outwardly facing wing portion which is embodied in a radially outwardly opening U-shaped or V-shaped manner in a cross section along the rotor axis.

15. The rotor disk arrangement as claimed in claim 1, wherein the first sealing element comprises, on each of the first side peripheries that are opposite one another in the circumferential direction, a respective sealing tab, with a constant material thickness, and the second adjacent sealing element comprises, on each of the second side peripheries that are opposite one another in the circumferential direction, a respective sealing shoulder.

16. The rotor disk arrangement as claimed in claim 1, further comprising at least one sealing element that has side peripheries that are opposite one another in the circumferential direction and extend parallel to one another.

17. A rotor having a rotor disk arrangement as claimed in claim 1.

18. A gas turbine having a rotor as claimed in claim 17.

19. A rotor disk arrangement having a rotor disk which comprises, distributed around the outer circumference, a plurality of axially extending blade holding grooves and an encircling fastening protrusion and/or a plurality of fastening protrusions arranged in a circumferentially distributed manner, and a plurality of sealing elements arranged in a circumferentially distributed manner, said sealing elements covering the blade holding grooves at least in portions on an end side and comprising, on the side facing a rotor axis, at least one fastening portion that bears against the underside of the fastening protrusion, wherein the fastening protrusion is embodied in an undercut manner, wherein the distance thereof from the rotor axis at a free end facing away from the rotor disk is less than in a region within the fastening protrusion, wherein the rotor disk has at least two undercut radial depressions that are arranged in a circumferentially distributed manner in each case between blade holding grooves, and at least two sealing elements each have at least one elevation that engages in the depression, wherein the fastening receptacle forms a free space radially above the fastening protrusion, said free space allowing a removal movement, at least toward the rotor axis, of the elevation out of the depression, and wherein the free space is covered by a securing plate.

20. A rotor disk arrangement having a rotor disk which comprises, distributed around the outer circumference, a plurality of axially extending blade holding grooves and an encircling fastening protrusion and/or a plurality of fastening protrusions arranged in a circumferentially distributed manner, and a plurality of sealing elements arranged in a circumferentially distributed manner, said sealing elements covering the blade holding grooves at least in portions on an end side and comprising, on the side facing a rotor axis, at least one fastening portion that bears against the underside of the fastening protrusion, wherein the fastening protrusion is embodied in an undercut manner, wherein the distance thereof from the rotor axis at a free end facing away from the rotor disk is less than in a region within the fastening protrusion, and wherein the sealing element has a substantially flat sealing portion facing the rotor axis, and a radially outwardly facing wing portion which is embodied in a radially outwardly opening U-shaped or V-shaped manner in a cross section along the rotor axis.

* * * * *